US012773076B2

(12) United States Patent
Lee et al.

(10) Patent No.: US 12,773,076 B2
(45) Date of Patent: Oct. 27, 2026

(54) CLEANER

(71) Applicant: Samsung Electronics Co., Ltd., Suwon-si (KR)

(72) Inventors: Nokhaeng Lee, Suwon-si (KR); Jeawon Lee, Suwon-si (KR); Jeonghoon Kang, Suwon-si (KR); Hooijoong Kim, Suwon-si (KR); Hwagyu Song, Suwon-si (KR); Sungcheol Lee, Suwon-si (KR); Jinho Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 336 days.

(21) Appl. No.: 18/540,562

(22) Filed: Dec. 14, 2023

(65) Prior Publication Data

US 2024/0215777 A1 Jul. 4, 2024

Related U.S. Application Data

(63) Continuation of application No. PCT/KR2023/019698, filed on Dec. 1, 2023.

(30) Foreign Application Priority Data

Dec. 28, 2022 (KR) ..... 10-2022-0187732

(51) Int. Cl.
*A47L 5/28* (2006.01)
*A47L 9/00* (2006.01)
*A47L 9/12* (2006.01)

(52) U.S. Cl.
CPC ..... *A47L 5/28* (2013.01); *A47L 9/0081* (2013.01); *A47L 9/127* (2013.01)

(58) Field of Classification Search
CPC ..... A47L 5/28; A47L 9/0081; A47L 9/127
See application file for complete search history.

(56) References Cited

U.S. PATENT DOCUMENTS 3,866,263 A * 2/1975 Crouser ..... A47L 9/0081 15/422.2
6,289,553 B1 9/2001 Dyson
(Continued)

FOREIGN PATENT DOCUMENTS

JP 2541990 Y2 7/1997
JP 2013-536736 A 9/2013
(Continued)

OTHER PUBLICATIONS

International Search Report and Written Opinion of the International Searching Authority dated Mar. 20, 2024, in connection with International Application No. PCT/KR2023/019698, 10 pages.

*Primary Examiner* — Andrew A Horton

(57) ABSTRACT

Provided is a cleaner including: a main body; and a fan motor configured to generate a suction force inside the main body, wherein the fan motor includes: a motor configured to generate a rotational force; an impeller rotatable by the motor; and a diffuser configured to guide air discharged from the impeller, and wherein the main body includes: a body including a reduction part configured to reduce a maximum flow rate while maintaining an average flow rate of air discharged from the diffuser, and a body outlet configured to guide the air passed through the reduction part; and a filter with at least a portion disposed across the body outlet to filter out rubbish from the air discharged from the body outlet.

20 Claims, 7 Drawing Sheets

(56) References Cited

U.S. PATENT DOCUMENTS

| | | | | |
|---|---|---|---|---|
| 11,306,730 | B2 | 4/2022 | Kim et al. | |
| 11,382,470 | B2 | 7/2022 | Hinchliffe et al. | |
| 11,686,314 | B2 | 6/2023 | Lee et al. | |
| 2009/0260179 | A1 | 10/2009 | Walker | |
| 2012/0047682 | A1 | 3/2012 | Makarov et al. | |
| 2020/0037834 | A1* | 2/2020 | Li | A47L 9/322 |
| 2021/0401248 | A1* | 12/2021 | King | A47L 5/24 |
| 2022/0049719 | A1 | 2/2022 | Choi et al. | |

FOREIGN PATENT DOCUMENTS

| | | | |
|---|---|---|---|
| KR | 10-0236012 | B1 | 12/1999 |
| KR | 20-2000-0000976 | U | 1/2000 |
| KR | 10-2001-0024752 | A | 3/2001 |
| KR | 10-2004-0026908 | A | 4/2004 |
| KR | 10-0504854 | B1 | 7/2005 |
| KR | 10-2007-0068937 | A | 7/2007 |
| KR | 10-2009-0051345 | A | 5/2009 |
| KR | 10-2013-0003705 | A | 1/2013 |
| KR | 10-1924591 | B1 | 12/2018 |
| KR | 10-2078716 | B1 | 2/2020 |
| KR | 10-2020-0044737 | A | 4/2020 |
| KR | 10-2020-0096968 | A | 8/2020 |
| KR | 10-2021-0088613 | A | 7/2021 |
| KR | 10-2021-0151021 | A | 12/2021 |

* cited by examiner

CLEANER

CROSS-REFERENCE TO RELATED APPLICATIONS

This application is a Bypass Continuation of International Application No. PCT/KR2023/019698, filed Dec. 1, 2023, which claims priority to Korean Patent Application No. 10-2022-0187732, filed Dec. 28, 2022, the disclosures of which are herein incorporated by reference in their entirety.

BACKGROUND

1. Field

The disclosure relates to a cleaner having a filter.

2. Description of Related Art

Cleaners are devices that remove rubbish from indoors to clean an indoor space, and generally, vacuum cleaners are commonly used in households. Vacuum cleaners draw in air using the suction force of a fan motor and separate rubbish from the drawn air using a device, such as a filter, to clean an indoor space. Such vacuum cleaners include a canister type vacuum cleaner and an upright type vacuum cleaner. In recent years, robot vacuums that perform a cleaning task by autonomously traveling around a cleaning area without a user's manipulation and drawing in rubbish, such as dust, from a surface to be cleaned have become popular.

The cleaner may include a fan motor that generates a suction force. The fan motor may be configured to draw external air and rubbish into the cleaner and then discharge air, in which rubbish has been filtered out, to the outside of the cleaner.

The cleaner may include a filter for filtering out fine-sized rubbish, such as fine dust, from the rubbish-filtered air to be discharged to the outside of the cleaner. In the cleaner, when high-speed air passing through the fan motor enters the filter, which generates strong turbulence, and results in significant noise.

SUMMARY

Therefore, it is an aspect of the disclosure to provide a cleaner capable of reducing noise.

It is an aspect of the disclosure to provide a cleaner with an enhanced efficiency.

It is an aspect of the disclosure to provide a cleaner in which heat dissipation efficiency of a motor is increased.

The technical objectives of the disclosure are not limited to the above, and other objectives may become apparent to those of ordinary skill in the art based on the following descriptions.

In accordance with an aspect of the disclosure, there is provided a cleaner including: a main body; and a fan motor configured to generate a suction force inside the main body, wherein the fan motor includes: a motor configured to generate a rotational force; an impeller rotatable by the motor; and a diffuser configured to guide air discharged from the impeller, and wherein the main body includes: a body including a reduction part configured to reduce a maximum flow rate while maintaining an average flow rate of air discharged from the diffuser, and a body outlet configured to guide the air passed through the reduction part; and a filter with at least a portion disposed across the body outlet to filter out rubbish from the air discharged from the body outlet.

The reduction part may be formed to block air from the diffuser from being discharged to the filter while passing through the reduction part.

The reduction part may extend in a direction of a rotational axis of the impeller.

The reduction part may have an extension length in the direction of the rotational axis of the impeller that may be greater than or equal to 0.45 times an outer diameter of the diffuser.

The reduction part may have a cross-sectional area perpendicular to a rotational axis of the impeller that may be larger than an area of an outlet of the diffuser.

The cleaner may further include a reduction member disposed in the reducing part to reduce a flow rate of the air discharged from the diffuser.

The reduction part may have a cylindrical shape with both sides open.

The reduction part may extend from the diffuser to the body outlet.

The filter may be detachably mounted on the body.

The cleaner may further include a filter housing detachably mounted on the body to cover the filter and having a cover outlet configured to discharge air passed through the filter to an outside of the main body.

The filter may extend from the body outlet to the cover outlet.

The filter may be provided as a high efficiency particulate air (HEPA) filter.

The motor may be disposed on another side opposite to a side of the impeller on which the diffuser may be disposed.

The diffuser may be configured to discharge air in a direction parallel to a rotational axis of the impeller.

The filter may extend along an outer circumferential surface of the main body on which the body outlet may be formed.

The reduction part may be configured to delay discharge of the air from the diffuser to the filter.

In accordance with an aspect of the disclosure, there is provided a cleaner including: a main body; and a fan motor configured to generate a suction force inside the main body, wherein the fan motor includes: a motor configured to generate rotational force; an impeller rotatable by the motor; and a diffuser configured to guide air discharged from the impeller, wherein the main body includes: a body outlet configured to guide the air discharged through the diffuser; a filter with at least a portion extending to surround the body outlet to filter out rubbish from the air discharged from the body outlet; and a reduction part extending between the diffuser and the body outlet to reduce a maximum flow rate of air discharged from the diffuser while maintaining an average flow rate of the air, the reduction part configured to block the air from the diffuser from discharging to the filter while passing through the reduction part.

The reduction part may have a cross-sectional area perpendicular to a rotational axis of the impeller that may be larger than an area of an outlet of the diffuser.

The cleaner may further include a filter housing having a cover outlet configured to cover the filter and configured to discharge air passed through the filter to an outside of the body, wherein the filter may extend from the body outlet to the cover outlet.

The reduction part may have an extension length in the direction of the rotational axis of the impeller that may be greater than or equal to 0.45 times an outer diameter of the diffuser.

The motor may be disposed on another side opposite to a side of the impeller on which the diffuser may be disposed.

According to a concept of the disclosure, the cleaner is provided with a reduction part that guides air discharged from a fan motor to a filter by reducing the maximum flow rate of the while maintaining the average flow rate, that is, while preventing a decrease in the air volume.

According to the concept of the disclosure, the cleaner is provided with a reduction part of which a cross-sectional area perpendicular a direction of a rotational axis of an impeller is larger than an area of an outlet of a diffuser, and thus an increased efficiency can be increased.

According to the concept of the disclosure, the cleaner is provided with a motor, an impeller, and a diffuser sequentially disposed in a direction in which air passed through a dust collection device is discharged to the outside of the cleaner, which allows relatively low-temperature air to pass through the motor, improving heat dissipation of the motor.

The effects of the disclosure are not limited to the effects described above, and other effects that are not described will be clearly understood by those skilled in the art from the following description.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
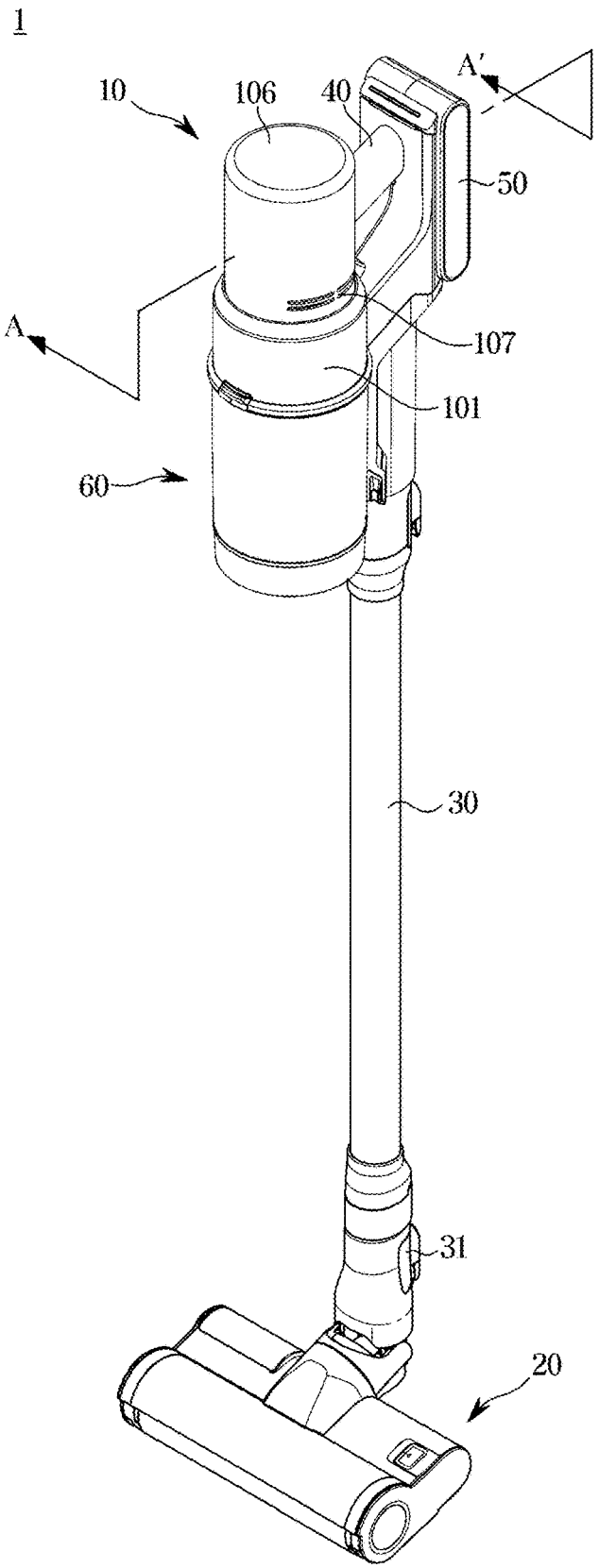
FIG. 1 is a view illustrating a cleaner according to an embodiment of the disclosure.

FIGS. 1 through 7, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

The various embodiments of the disclosure and terminology used herein are not intended to limit the technical features of the disclosure to the specific embodiments, but rather should be understood to cover all modifications, equivalents, and alternatives falling within the concept and scope of the disclosure.

In the description of the drawings, like numbers refer to like elements throughout the description of the drawings.

The singular forms preceded by "a," "an," and "the" corresponding to an item are intended to include the plural forms as well unless the context clearly indicates otherwise.

In the disclosure, a phrase such as "A or B," "at least one of A and B," "at least one of A or B," "A, B or C," "at least one of A, B and C," and "at least one of A, B, or C" may include any one of the items listed together in the corresponding phrase of the phrases, or any possible combination thereof.

The term "and/or" includes combinations of one or all of a plurality of associated listed items.

As used herein, such terms as "1st" and "2nd," or "first" and "second" may be used to simply distinguish a corresponding component from another, and does not limit the components in other aspect (for example, importance or order).

When one (e.g., a first) element is referred to as being "coupled" or "connected" to another (e.g., a second) element with or without the term "functionally" or "communicatively," it means that the one element is connected to the other element directly, wirelessly, or via a third element.

It will be understood that the terms "include", "comprise" and/or "have" when used in this specification, specify the presence of stated features, integers, steps, operations, elements, and/or components, but do not preclude the presence or addition of one or more other features, integers, steps, operations, elements, components, and/or groups thereof.

It is to be understood that if a certain component is referred to as being "coupled with," "coupled to," "supported on" or "in contact with" another component, it means that the component may be coupled with the other component directly or indirectly via a third component.

In the description of an embodiment, it will be understood that, when an element is referred to as being "on/under" another element, it may be directly on/under the other element, or one or more elements may also be present.

Hereinafter, embodiments according to the present disclosure will be described in detail with reference to the accompanying drawings.

Although a stick cleaner, which is a type of a cleaner, will be described as an example for convenience of description, the configuration of the disclosure is not limited to the stick cleaner. For example, the configuration of the disclosure may be applied to a canister-type cleaner, a robot cleaner, and the like.

Figure 2:
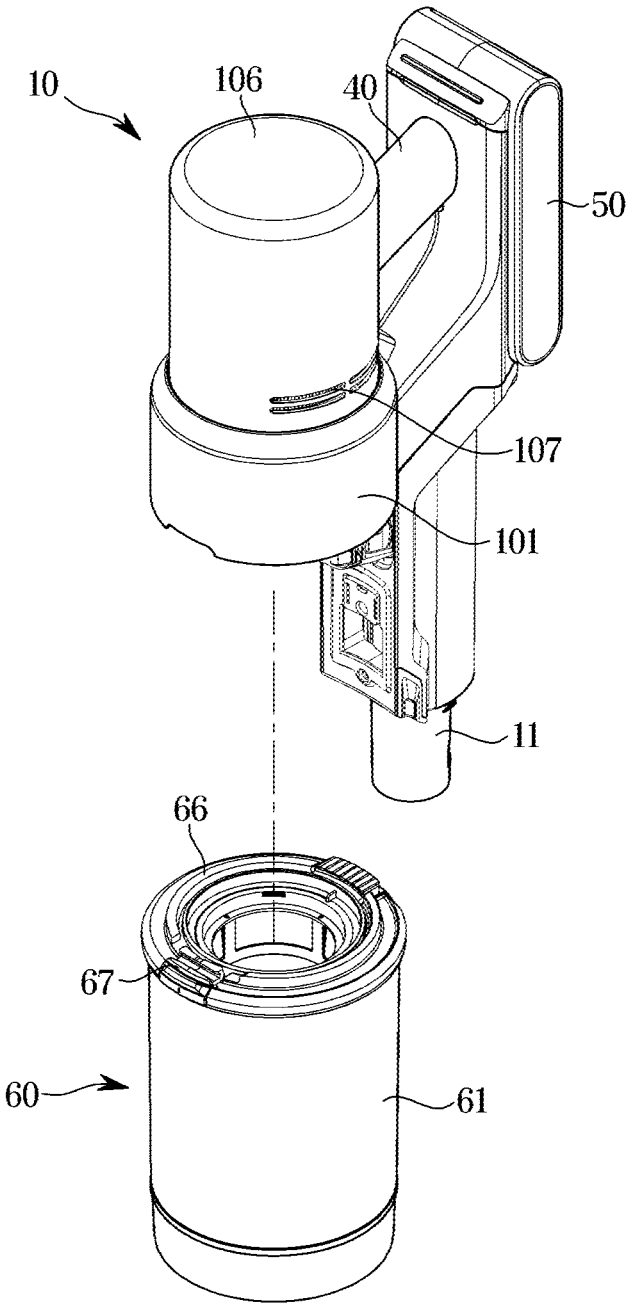
FIG. 2 is a view illustrating a state in which a dust collection device is separated from a main body shown in FIG. 1.
Figure 3:
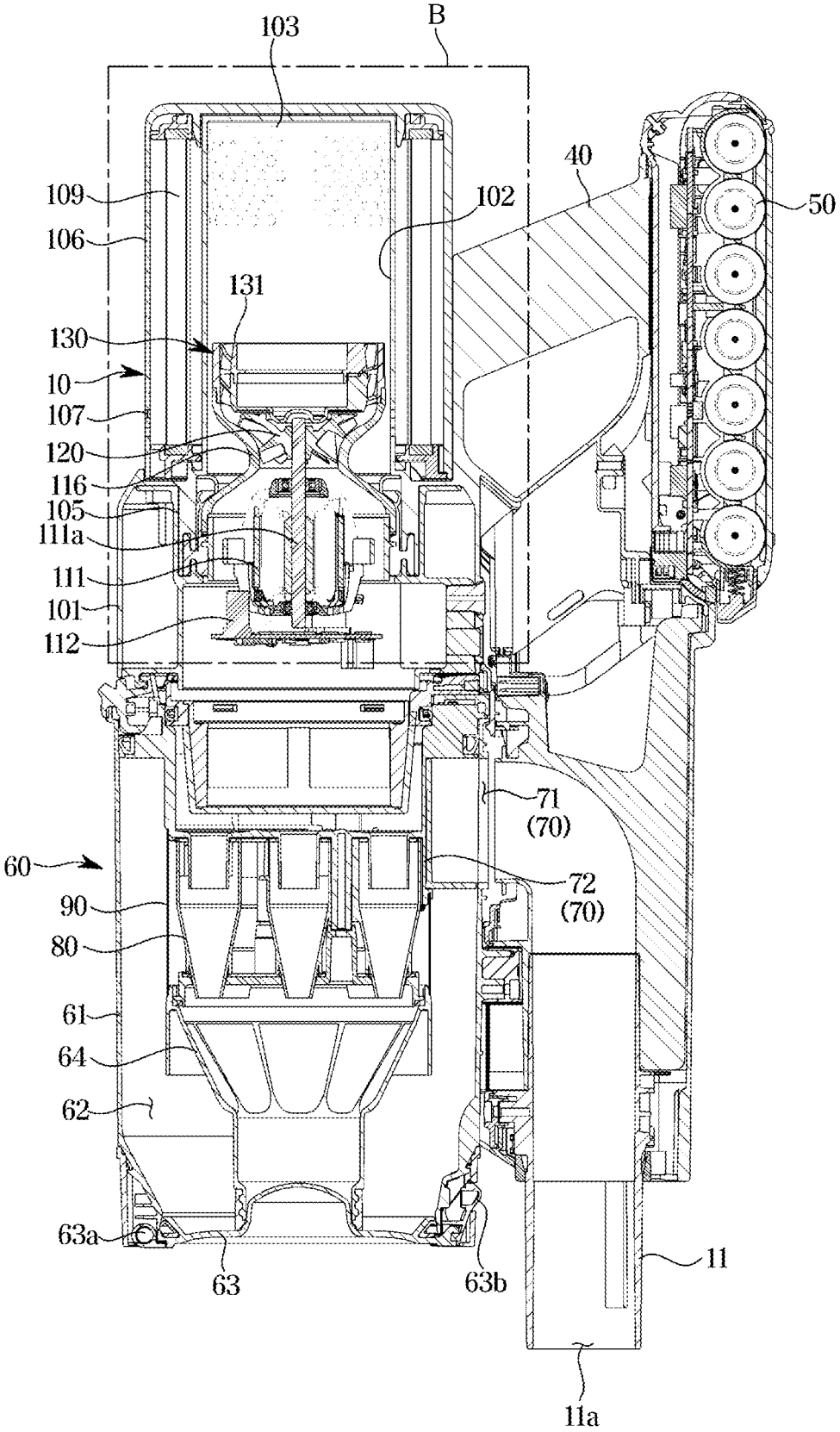
FIG. 3 is a view illustrating a cross section taken along line A-A' indicated in FIG. 1.

FIG. 1 is a view illustrating a cleaner according to an embodiment of the disclosure. FIG. 2 is a view illustrating a state in which a dust collection device is separated from a main body shown in FIG. 1. FIG. 3 is a view illustrating a cross section taken along line A-A' indicated in FIG. 1.

Referring to FIGS. 1 to 3, a cleaner 1 may include a suction head 20 configured to intake rubbish, such as dust, from a surface to be cleaned by an air suction force, and a main body 10 configured to allow the rubbish intaken through the suction head 20 to be collected therein.

The cleaner 1 may include a connection pipe 30 provided to connect the suction head 20 and the main body 10 to each other.

The suction head 20 may include a suction brush and may intake air and foreign substances from a surface to be cleaned while being in close contact with the surface to be cleaned. The suction head 20 may be rotatably coupled to the connection pipe 30.

The connection pipe 30 may be formed as a pipe having a predetermined rigidity or a flexible hose. The connection pipe 30 may transfer the suction force generated through a fan motor 110 to the suction head 20 and guide air and rubbish, such as dust, and the like intaken through the suction head 20, to the main body 10.

The connection pipe 30 may further include a suction head connector 31. The suction head connector 31 may be provided to allow the suction head 20 to be separated from or coupled to the main body 10.

The main body 10 includes a dust collection device 60 configured to separate rubbish from intaken air and collect the separated rubbish, a handle 40 provided to be gripped by a user, and a battery 50 provided to supply power required to drive parts of the cleaner 1, such as a fan motor 110.

The main body 10 may include a main body intake port 11*a* through which air and rubbish are intaken into the main body 10. The main body 10 may include a main body suction duct 11 communicating with one end of the connection pipe 30. The main body intake port 11*a* may be formed at an end of the main body suction duct 11 that is connected to an end of the connection pipe 30. Air and rubbish intaken by the suction head 20 may pass through the connection pipe 30, flowing through the body intake port 11*a* of the body suction duct 11, and then into the main body 10. However, it is not limited thereto, the main body intake port 11*a* and the connection pipe 30 may be directly connected to each other rather than the main body 10. The main body can include a duct structure, such as the main body suction duct 11.

The main body 10 may include a manipulation part. For example, the user may turn on/off the cleaner 1 or adjust the suction strength by manipulating a button or the like provided on the manipulation part.

The battery 50 may be detachably mounted on the main body 10. For example, the battery 50 may be electrically connected to a charging terminal provided in a cleaner holder or a docking station. The battery 50 may be charged by receiving power from the charging terminal provided in the cleaner holder or the docking station.

The main body 10 may be provided with a dust collection device 60. The dust collection device 60 may be disposed upstream of the motor 111 in a flow direction of air to separate rubbish from air introduced into the dust collection device 60 and collect the separated rubbish.

The dust collection device 60 may include a dust collection case 61 provided to collect foreign substances separated from the air. The dust collection case 61 may form the external appearance of the dust collection device 60. The dust collection case 61 may have a dust collection chamber 62 formed therein such that foreign substances separated from the air are collected. The dust collection chamber 62 is a space in which foreign substances separated by a first dust collection device (a first cyclone) 70 are collected, and may be referred to as a first dust collection chamber 62. Similarly, the dust collection case 61 forming the first dust collection chamber 62 may be referred to as a first dust collection case 61.

The first dust collection case 61 may be provided at one side thereof with an inlet 71 through which air is introduced from the suction head 20 into the first dust collection chamber 62. The inlet 71 is formed to communicate with the main body suction duct 11, and air introduced through the main body intake port 11*a* into the main body 10 may be introduced into the dust collection device 60 through the inlet 71. As will be described below, the inlet 71 may be referred to as a first cyclone inlet 71 by allowing introduction of air and rubbish into the first cyclone 70.

The dust collection device 60 may be detachably coupled from other components of the main body 10.

The dust collection device 60 may include a connection cover 66 connecting the dust collection device 60 to other components of the main body 10 and a coupling button 67 provided on one side of the connection cover 66 and allowing the dust collection device 60 to be detachably coupled to other components of the main body 10. More specifically, as shown in FIGS. 1 to 3, the connection cover 66 and the coupling button 67 may be positioned between the body 101 and the first dust collection case 61.

The coupling button 67 may be provided to be engaged with one side of the main body 10. As the coupling button 67 is engaged with one side of the main body 10, the dust collection device 60 may be mounted on the main body 10.

The coupling button 67, in response to the coupling button 67 being pressed by the user in a state in which the dust collection device 60 is mounted on the main body 10, may be released from the engagement, and thus the dust collection device 60 may be separated from the main body 10.

When the dust collection device 60 is separated from other components of the main body 10, the user may perform various operations, such as removing foreign substances collected in the dust collection device 60, cleaning the dust collection device 60, or repairing or replacing parts of the dust collection device 60 or the main body 10. However, the disclosure is not limited thereto, and the dust collection device 60 may be separated from the main body 10 in various ways.

The dust collection device 60 may include a dust collection case door 63 provided on the first dust collection case 61. The dust collection case door 63 may be provided on one side of the first dust collection case 63 to open and close the first dust collection chamber 62. Furthermore, the dust collection case door 63 may be provided to open and close a second dust collection chamber 64 to be described below.

The dust collection case door 53 may be provided on the first dust collection case 61 to be rotatable by a rotating shaft 63*a*. The dust collection case door 63 may include a door button 63*b*, and the door button 63*b* may be provided to be engaged with one side of the first dust collection case 61. In response to the door button 63*b* being engaged with the one side of the first dust collection case 61, the dust collection case door 63 may remain closed. In response to the door button 63*b* being pressed by the user while the dust collection case door 63 is closed, the door button 63*b* may be provided to be released from the engagement, and thus the dust collection case door 63 may be opened.

Accordingly, the user may easily remove foreign substances collected in the first dust collection chamber 62 or the second dust collection chamber 64 without separating the dust collection device 60 from the main body 10 or disassembling parts of the dust collection device 60, such as the dust collection case 61. However, the above description of the dust collection case door 63 is only an example for removing foreign substances collected from the dust collection device 60 of the cleaner 1 according to the concept of the disclosure, and the concept of the disclosure is not limited thereto.

The dust collection device 60 may include a first dust collection device 70 configured to primarily separate air and rubbish introduced through the first cyclone inlet 71, and a second dust collection device 80 into which air discharged after separation of rubbish by the first dust collection device 70 is introduced, configured to secondarily separate foreign substances from the air.

Each of the first dust collection device 70 and the second dust collection device 80 may be a cyclone-type dust collection device.

The cyclone-type dust collection device may separate foreign substances with a centrifugal force that is generated by a rotational flow of air and foreign substances inside the cyclone-type dust collection device, and may have an inlet for admitting air in a structure that guides a rotational flow of air, such as a helical inlet, a tangential inlet, a guide vane inlet, and the like.

For example, the first dust collection device 70 may include a first cyclone guide 72 for guiding air and rubbish introduced through the first cyclone inlet 71 to perform a rotational flow. In addition, the second dust collection device 80 may include an inlet duct for admitting air and rubbish discharged from the first dust collection device 70 introduced into the second dust collection device 80 and guiding the introduced air and rubbish to perform a rotational flow.

The foreign substances primarily separated by the first dust collection device 70 may include foreign substances having a relatively large size. For example, the first dust collection device 70 may be formed to allow air to flow with a relatively large rotational radius by the first cyclone guide 72, and the first dust collection chamber 62 may also be formed large to correspond to the first dust collection device 70.

The second dust collection device 80 may separate relatively small-sized foreign substances, which have not been sufficiently separated by the first dust collection device 70, from air.

A cyclone cover 90 may be disposed between the first dust collection device 70 and the second dust collection device 80. The cyclone cover 90 may be provided to allow air and rubbish discharged from the first dust collection device 70 to flow into the second dust collection device 80 by passing through the cyclone cover 90. In other words, the cyclone cover 90 may function as an outlet of the first dust collection device 70 and an inlet of the second dust collection device 80.

With such a configuration, when a suction force is generated by the fan motor 110 inside the main body 10, air and rubbish may be drawn into the suction head 20. The air and rubbish intaken into the suction head 20 may be drawn into the main body 10 via the connection pipe 30 and the main body intake port 11*a*. The air introduced into the main body 10 may be caused to flow into the dust collection device 60 through the inlet (the first cyclone inlet) 71. Foreign substances introduced into the dust collection device 60 may be primarily separated by the first dust collection device 70 and collected in the first dust collection chamber 62. The air in which the foreign substances have been separated by the first dust collection device 70 may be discharged from the first dust collection device 70 through the cyclone cover 90 and then introduced into the second dust collection device 80. Foreign substances introduced into the second dust collection device 80 may be secondarily separated by the second dust collection device 80 and collected in the second dust collection chamber 64. The air in which the foreign substances have been separated by the second dust collection device 80 may be caused to flow toward the fan motor 110.

For example, the first dust collection device 70 may not be configured as a cyclone-type dust collection device. For example, the first dust collection device according to the concept of the disclosure, which is a dust collection device for primarily separating foreign substances from air introduced from a suction head, may be for example, a dust collection device for separating foreign substances through a porous filter, and other various types of dust collection devices.

Figure 4:
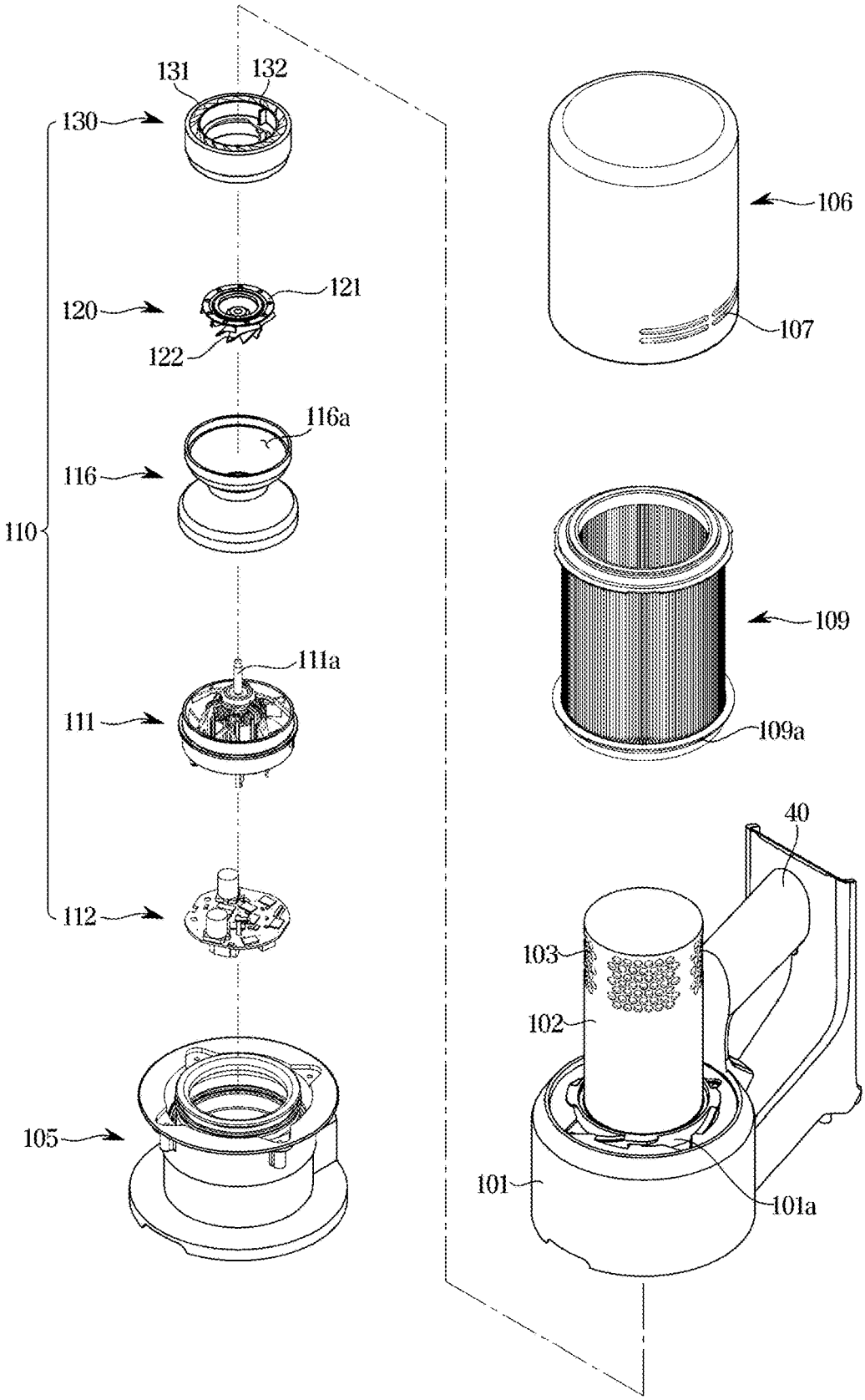
FIG. 4 is an exploded view illustrating a fan motor disposed inside a main body shown in FIG. 1.
Figure 5:
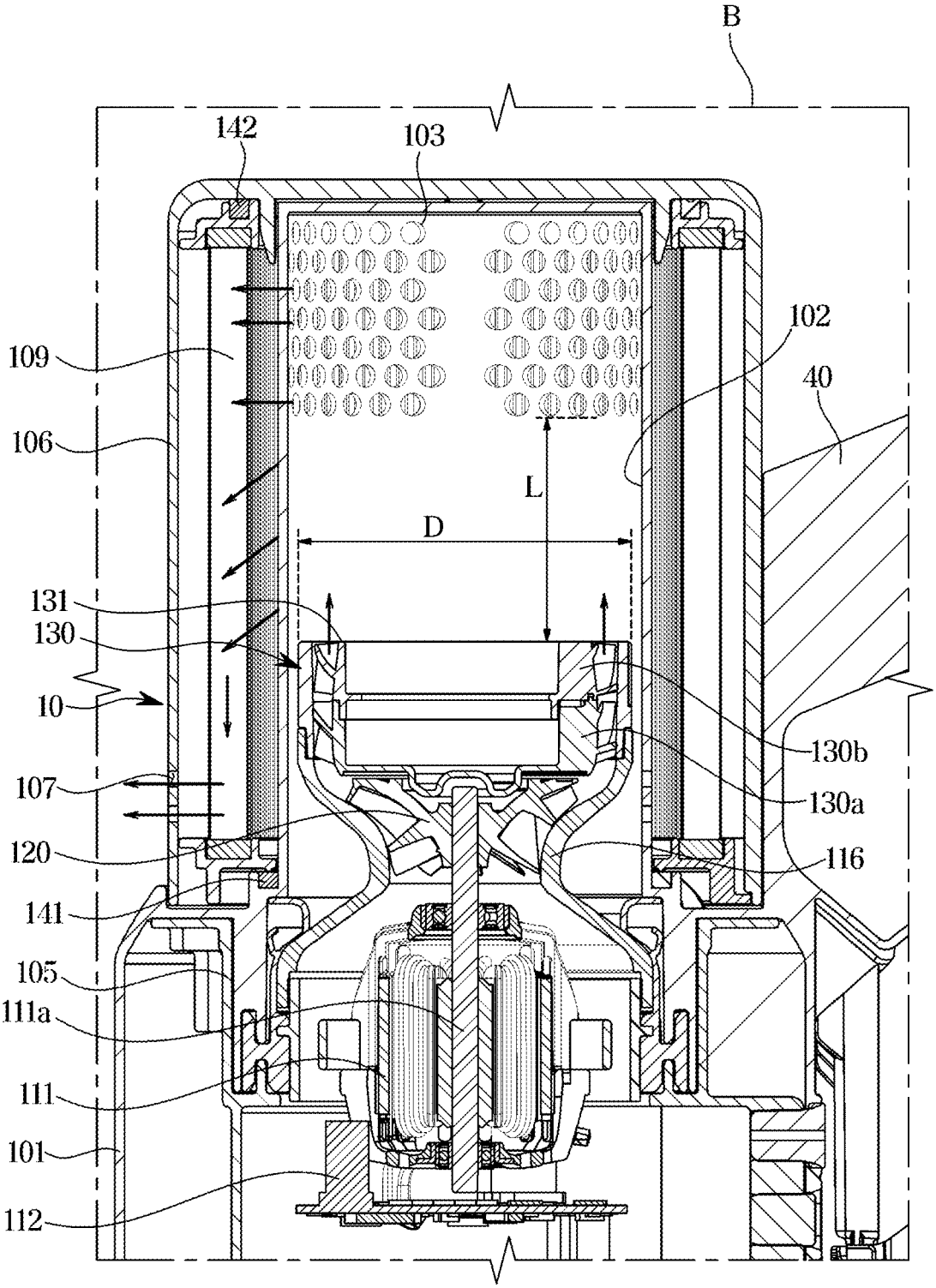
FIG. 5 is an enlarged view illustrating portion B shown in FIG. 3.

FIG. 4 is an exploded view illustrating a fan motor disposed inside a main body shown in FIG. 1. FIG. 5 is an enlarged view illustrating portion B shown in FIG. 3

Referring to FIGS. 4 and 5, the main body 10 may include a body 101. The handle 40 may be formed on the body 101. The fan motor 110 may be accommodated inside the body 101.

The cleaner 1 may include a filter housing 106 detachably mounted on the body 101. The main body 10 may include the filter housing 106. A filter 109 may be accommodated inside the filter housing 106.

The filter housing 106 may include a cover outlet 107 for discharging air passed through the filter 109 to the outside of the main body 10. Air inside the cleaner 1 may be discharged to the outside of the cleaner 1 through the cover outlet 107. For example, the cover outlet 107 may have a slit shape. For example, the cover outlet 107 may have a circular shape. The cover outlet 107 may be formed along an outer circumferential surface of the filter housing 106.

The cleaner 1 may include a filter 109. The filter 109 may be accommodated inside the filter housing 106. The filter 109 may filter out rubbish from air discharged from the body outlet 103 of the body 101.

The filter 109 may be disposed to have at least one portion thereof across the body outlet 103. The filter 109 may extend along an outer circumferential surface of the main body 10 on which the body outlet 103 is formed. The filter 109 may extend from the body outlet 103 to the cover outlet 107. As the filter 109 extends from the body outlet 103 to the cover outlet 107, air introduced into the space between the filter housing 106 and the body 101 through the body outlet 103 may be filtered by passing through the filter 109, and then discharged from the cover outlet 107. The filter 109 may be provided to surround a reduction part 102 and/or the body outlet 103 of the body 101. The filter 109 may have a substantially cylindrical shape with both sides open.

The filter 109 may be detachably mounted on the body 101. The filter 109 may include a body coupling portion 109*a* to be coupled to the body 101. The body 101 may include a filter coupling portion 101*a* to be coupled to the filter 109. As the body coupling portion 109*a* and the filter coupling portion 101*a* are coupled to each other, the filter 109 may be coupled to the body 101. The user may separate the filter 109 from the body 101 to perform maintenance and/or repair on the filter 109.

The filter 109 may be provided with a body sealing part 141 at one end thereof that is in contact with the body 101. The filter 109 may be provided with a housing sealing part 142 at the other end that is in contact with the filter housing 106. A flow path formed inside of the filter 109 and a flow path formed outside of the filter 109 may be divided and sealed by the body sealing part 141 and the housing sealing part 142.

The filter housing 106 may cover the filter 109. As the filter housing 106 is detachably mounted on the body 101, the user may easily replace the filter 109.

For example, the filter 109 may be a high efficiency particulate air (HEPA) filter. The filter 109 may filter fine-sized rubbish, such as fine dust, from air passed through the dust collection device 60. The air with fine dust filtered out by passing through the filter 109 may be discharged to the outside of the cleaner 1 through the cover outlet 107 of the filter housing 106.

The main body 10 may be provided inside thereof with a fan motor 110 configured to generate a suction force required to intake rubbish on a surface to be cleaned. The fan motor 110 may be accommodated inside the main body 10.

The fan motor 110 may be configured to generate a suction force inside the main body 10.

The fan motor 110 may include a motor 111 and a circuit board 112 for controlling the motor 111. The circuit board 112 may be disposed on a side opposite to a side of the motor 111 on which the impeller 120 is coupled.

The motor 111 may convert electromagnetic force into mechanical rotational force. The motor 111 may be configured to generate rotational force. The motor 111 may include a stator provided with a coil and a rotor having magnetism and rotatable by electromagnetic force. The motor 111 may include a motor shaft 111*a*. The motor shaft 111*a* may be provided to be rotatable by the rotor. The motor shaft 111*a* may be coupled to the impeller 120.

The motor 111 may be disposed on the other side of the impeller 120 opposite to one side on which the diffuser 130 is disposed. The motor 111, the impeller 120, and the diffuser 130 may be sequentially disposed in a direction in which air passed through the dust collection device 60 is discharged to the outside of the cleaner 1. The motor 111, the impeller 120, and the diffuser 130 are sequentially disposed in the direction in which air passed through the dust collection device 60 is discharged to the outside of the cleaner 1, which allows relatively low-temperature air to pass through the motor 111, and thus improving the heat dissipation efficiency of the motor 111.

The body 10 may include a motor case 105 in which the motor 111 and/or the circuit board 112 are mounted. The motor 111 and/or the circuit board 112 may be accommodated inside the motor case 105. The motor case 105 may cover the motor 111 and/or the circuit board 112. The motor case 105 may be accommodated inside the body 101. The motor case 105 may be coupled to the body 101.

The fan motor 110 may include the impeller 120 coupled to the motor 111 and configured to generate an airflow. The impeller 120 may be rotated by receiving power from the motor 111. The impeller 120 may be connected to the motor shaft 111*a*. The impeller 120 may receive power through the motor shaft 111*a* of the motor 111. While the impeller 120 is coupled to the motor shaft 111*a*, the impeller may rotate together with the motor shaft 111*a*.

The impeller 120 may include a hub 121 and a plurality of blades 122 protruding from the hub 121 to form an air flow.

The hub 121 may have a shape in which a cross section perpendicular to a rotational axis of the impeller 120 increases in a direction in which air introduced into the main body 10 is discharged. The impeller 120 may be provided to discharge air introduced in the direction of the rotational axis of the impeller 120 in a substantially radial direction of the impeller 120.

The plurality of blades 122 may extend from the hub 121. As the impeller 120 rotates, the plurality of blades 122 may form airflow together with the hub 121. The plurality of blades 122 may extend from a surface of the hub 121 to which air is introduced.

The fan motor 110 may include a motor cover 116 provided to cover at least a portion of the motor 111. The motor cover 116 may be provided to cover at least a portion of the impellor 120. The motor cover 116 may be coupled to one side of the motor 111.

The motor cover 116 may include an impeller accommodating portion 116*a* corresponding to the impeller 120 to accommodate the impeller 120. The impeller accommodating portion 116*a* may have a shape in which a cross-sectional area increases in a direction in which air flows. With such a configuration, the fan motor 110 may be provided with an improved efficiency.

The fan motor 110 may include a diffuser 130. The diffuser 130 may be provided to guide air discharged from the impeller 120. The diffuser 130 may diffuse air discharged from the impeller 120. The diffuser 130 may be provided to discharge air in a direction parallel to the rotational axis of the impeller 120.

The diffuser 130 may include a diffuser outlet 131 and a diffuser blade 132. Air passing through the diffuser 130 may be converted from a rotational flow to an axial flow by the diffuser blades 132. Air passing through the diffuser 130 may be diffused by the diffuser blade 132 and discharged from the diffuser 130.

For example, the diffuser 130 may be provided as a two-stage diffuser 130 in which two diffusers 130*a* and 130*b* are stacked along a direction in which air flows.

The cleaner 1 may include a reduction part 102 for reducing the maximum flow rate of air discharged from the diffuser 13 while maintaining the average flow rate of the air, i.e., without a decrease in the air volume. The reduction part 102 may reduce a flow rate of air discharged from the diffuser 130 while preventing a decrease in the air volume of the air. The reduction part 102 may reduce the maximum flow rate of air discharged from the diffuser 130 while maintaining the average flow rate of the air. As an example, the body 101 of the main body 10 may include the reduction part 102. As an example, the reduction part 102 may not be provided as a part of the body 101, but provided separately from and detachably couple to the body 101.

The reduction part 102 may be formed to block air from the diffuser 130 from discharging to the filter 109 while passing through the reduction part 102. Unlike the body outlet 103, the reduction part 102 may not have a hole formed therein. The air passing through the reduction part 102 may be reduced in the maximum flow rate without a decrease in the air volume, that is, while maintaining the average flow rate. The air passing through the reduction part 102 may be reduced in the maximum flow rate without a decrease in the average flow rate. The air passing through the reduction part 102 may be reduced in the maximum flow rate while maintaining an average flow rate. The air discharged from the diffuser 130 may pass through the reduction part 102, with the maximum flow rate reduced without a decrease in the air volume, that is, while maintaining the average flow rate, and flow into the filter 109 through the body outlet 103. Therefore, in the cleaner 1, noise generated from the filter 109 may be reduced and efficiency may be increased.

Referring to FIG. 5, the reduction part 102 may extend in the rotational axis direction of the impeller 120. The reduction part 102 may be formed to have an extension length L in the rotational axis direction of the impeller 120 that is greater than or equal to approximately 0.45 times an outer diameter D of the diffuser 130. As the reduction part 102 extends along the rotational axis direction of the impeller 120 at a length greater than or equal to approximately 0.45 times the outer diameter D of the diffuser 130, the air from the diffuser 130, may pass through the reduction part 102, with the maximum flow rate reduced without a decrease in the air volume, that is, while maintaining the average flow rate, and then introduced into the filter 109 through the body outlet 103, and thus the cleaner 1 may reduce noise generated from the filter 109 and improve efficiency.

The reduction part 102 may be formed to have a cross-sectional area perpendicular to the rotational axis of the impeller 120 that is larger than the area of the diffuser outlet 131 of the diffuser 130. As the cross-sectional area of the reduction part 102 perpendicular to the rotational axis of the impeller 120 is formed to be larger than the area of the diffuser outlet 131 of the diffuser 130, the air in the reduction part 102 may be reduced in the maximum flow rate without a decrease in the air volume, that is, while maintaining the average flow rate, and since the air in the reduction part 102 is reduced in the maximum flow rate without a decrease in the air volume, that is, while maintaining the average flow rate, the air pressure in the reduction part 102 may be increased, and the efficiency of the cleaner 1 may be increased. For example, the efficiency of the fan motor 110 of the cleaner 1 may be determined by an air volume and an air pressure. Since the air volume by the impeller 120 is constant, the increasing air pressure may enhance the efficiency of the fan motor 110 of the cleaner 1.

The reduction part 102 may have a cylindrical shape with open sides at opposite ends. An opening on one side of the reduction part 102 may align with the diffuser 130 and an opening on the other side of the reduction part 102 may align with the body outlet 103. The reduction part 102 may extend from the diffuser 130 to the body outlet 103. The reduction part 102 may be provided between the diffuser 130 and the body outlet 103. The reduction part 102 may form a flow path through which air discharged from the diffuser 130 moves to the body outlet 103.

The body 101 may include the body outlet 103 for guiding air passed through the reduction part 102. The body outlet 103 may guide air passed through the reduction part 102 to the filter 109. For example, the body outlet 103 may not be provided as a part of the body 101 but may be provided separately from the body 101 and detachably coupled to the body 101.

When air is discharged to the filter 109 through the body outlet 103, noise due to turbulence may occur. In the cleaner 1 according to the embodiment, air passing through the reduction part 102 is discharged to the filter 109 with the maximum flow rate reduced without a decrease in the air volume, that is, while maintaining the average flow rate, and thus noise may be reduced, and the efficiency may be improved.

Referring to FIG. 5, air in which rubbish has been filtered out by the dust collection device 60 may be introduced into the fan motor 110. The air introduced into the fan motor 110 may pass through the motor 111 and across the circuit board 112 and have heat exchanged with the motor 111 and the circuit board 112. Accordingly, heat from the motor 111 and the circuit board 112 may be dissipated.

The air passed through the motor 111 and across the circuit board 112 may pass through the impeller 120. The air passed through the impeller 120 may be introduced into the diffuser 130. The air passing through the diffuser 130 may be diffused and discharged.

The air discharged from the diffuser 130 may pass through the reduction part 102. In the reduction part 102, the air may be reduced in the maximum flow rate without a decrease in the air volume, that is, while maintaining the average flow rate. The air passed through the reduction part 102 may be discharged to a space between the body 101 and the filter housing 106 through the body outlet 103.

The air discharged into the space between the body 101 and the filter housing 106 is caused to pass through the filter 109. While the air is passing through the filter 109, fine-sized dust may be filtered out. The air passed through the filter 109 may be discharged to the outside of the cleaner 1 through the cover outlet 107 of the filter housing 106.

Figure 6:
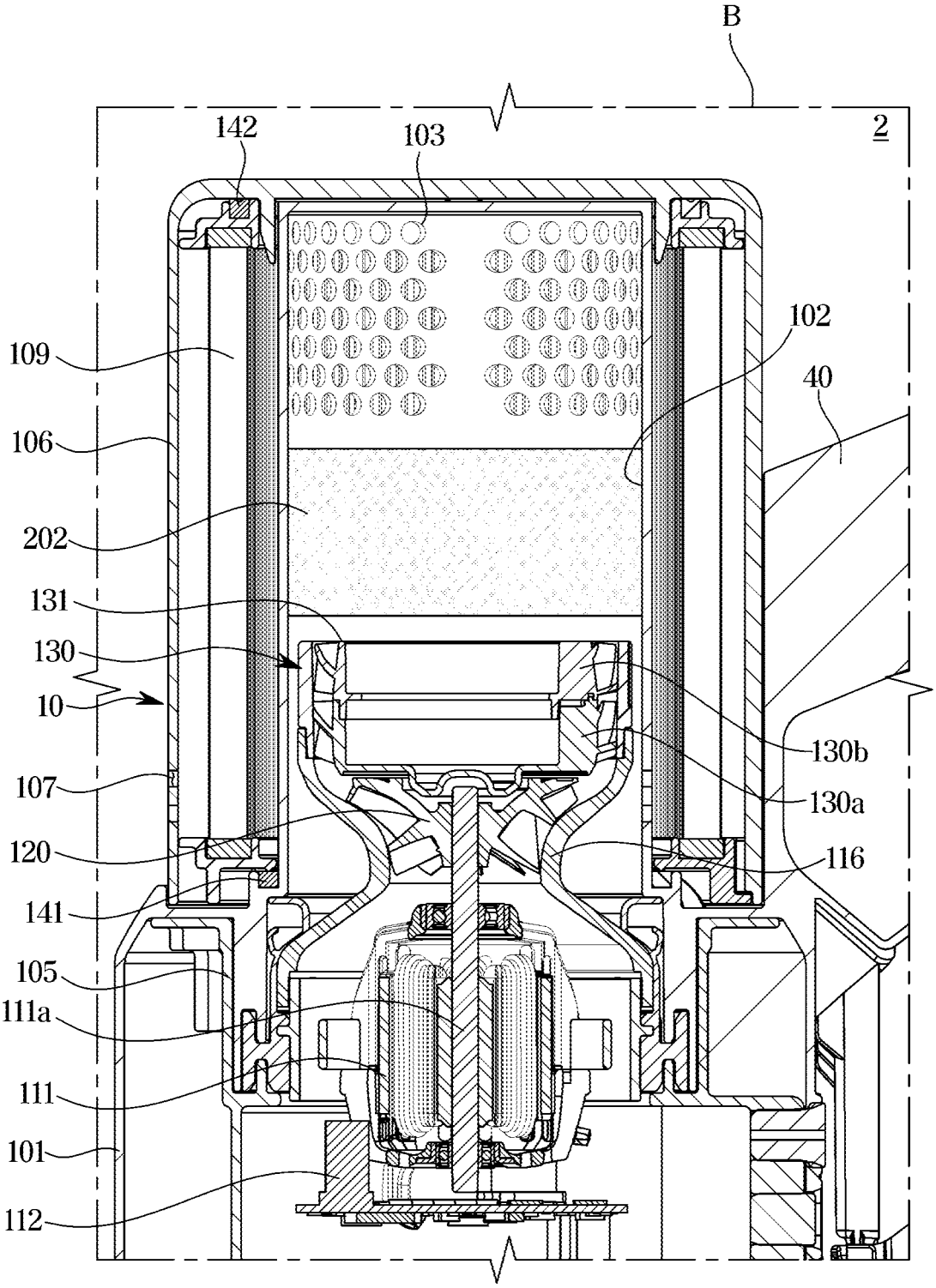
FIG. 6 is an enlarged view illustrating a portion of the inside of a main body of a cleaner according to an embodiment.

FIG. 6 is an enlarged view illustrating a portion of the inside of a main body of a cleaner according to an embodiment.

Referring to FIG. 6, a cleaner 2 according to an embodiment will be described. The same reference numerals are assigned to the same configurations as those of the cleaner 1 described with reference to FIGS. 1 to 5, and detailed description thereof may be omitted.

Referring to FIG. 6, the cleaner 2 may include a reduction part 102 for reducing the maximum flow rate of the air discharged from the diffuser 130 without a decrease in the air volume, that is, while maintaining the average flow rate. The cleaner 2 may include a reduction member 202 disposed on the reduction part 102.

The reduction member 202 may be provided to reduce the maximum flow rate of the air passing through the reduction part 102 without a decrease in the air volume, that is, while maintaining the average flow rate. The reduction member 202 may include a porous material. The reduction member 202 may include a material capable of absorbing noise.

Referring to FIG. 6, air in which rubbish has been filtered out by the dust collection device 60 may be introduced into the fan motor 110. The air introduced into the fan motor 110 may pass through the motor 111 and across the circuit board 112 and have heat exchanged with the motor 111 and the circuit board 112. Accordingly, heat of the motor 111 and the circuit board 112 may be dissipated.

The air passed through the motor 111 and across the circuit board 112 may pass through the impeller 120. The air passed through the impeller 120 may be introduced into the diffuser 130. The air passing through the diffuser 130 may be diffused and discharged.

The air discharged from the diffuser 130 may pass through the reduction part 102. In the reduction part 102, the air may be reduced in the maximum flow rate without a decrease in the air volume, that is, while maintaining the average flow rate. The air discharged from the diffuser 130 may be reduced in the maximum flow rate by the reduction member 202 disposed in the reduction part 102 without a decrease in the air volume, that is, while maintaining the average flow rate. The air passed through the reduction part 102 may be discharged to a space between the body 101 and the filter housing 106 through the body outlet 103.

The air discharged into the space between the body 101 and the filter housing 106 is caused to pass through the filter 109. While the air is passing through the filter 109, fine-sized dust may be filtered out. The air passed through the filter 109 may be discharged to the outside of the cleaner 2 through the cover outlet 107 of the filter housing 106.

Since the cleaner 2 shown in FIG. 6 may allow the reduction part 102 and the reduction member 202 to reduce the maximum flow rate of air without a decrease in the air flow rate, that is, while maintaining the average flow rate, to a greater extent than the cleaner 1 shown in FIGS. 1 to 5, and thus noise generated from the filter 109 may be reduced to a greater extent.

Figure 7:
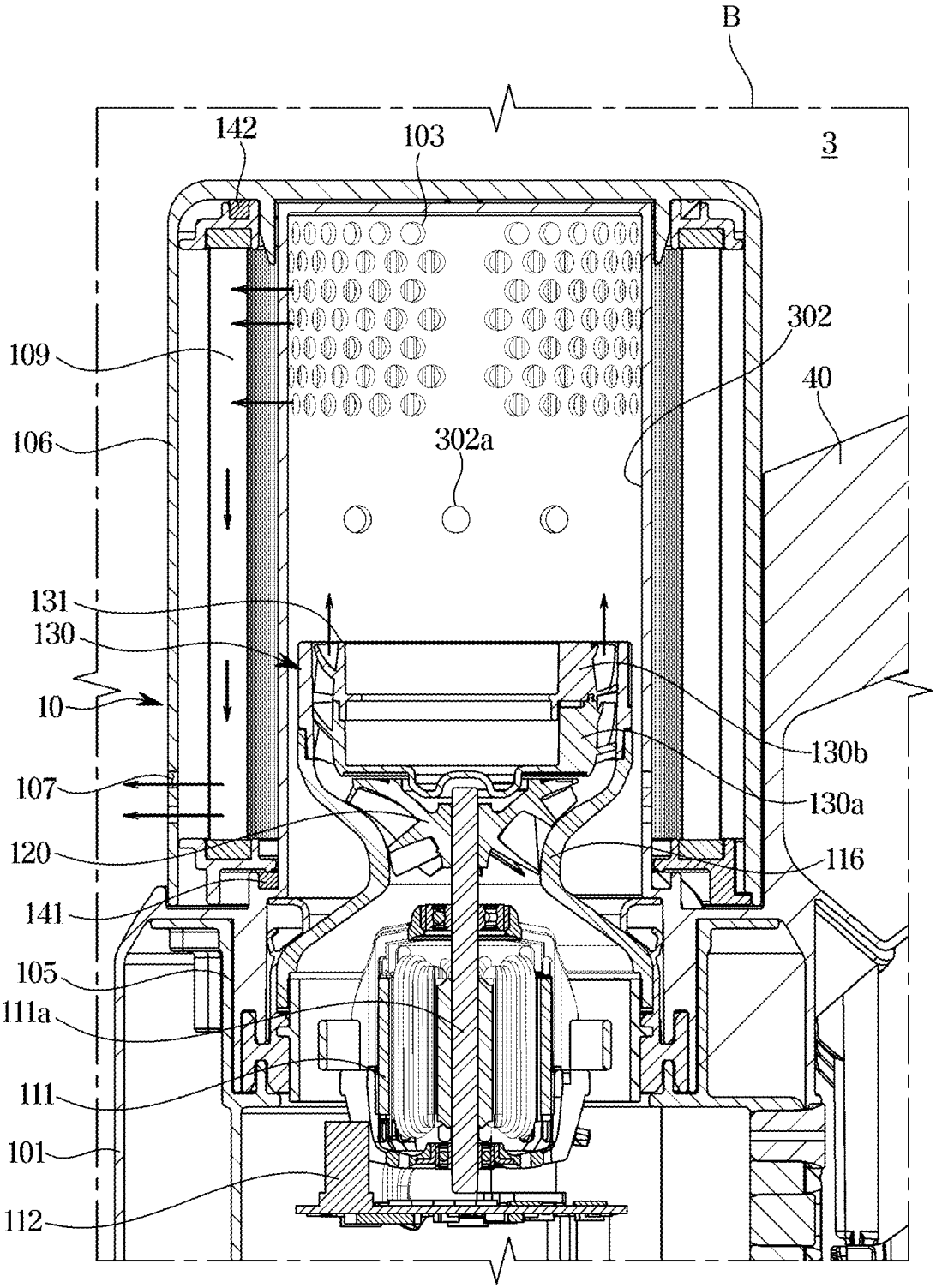
FIG. 7 is an enlarged view illustrating a portion of the inside of a main body of a cleaner according to an embodiment.

FIG. 7 is an enlarged view illustrating a portion of the inside of a main body of a cleaner according to an embodiment.

Referring to FIG. 7, a cleaner 3 according to an embodiment will be described. The same reference numerals are assigned to the same configurations as those of the cleaner 1 described with reference to FIGS. 1 to 5, and detailed description thereof may be omitted.

Referring to FIG. 7, a cleaner 3 includes a reduction part 302 for reducing the maximum flow rate of air discharged from the diffuser 130 without a decrease in the air volume, that is, while maintaining the average flow rate. The reduction part 302 may include at least one hole 302*a*. The reduction part 302 may include holes 302*a* of which the number is less than or equal to a predetermined number and/or the area is smaller than or equal to a predetermined area. Most of the air discharged from the diffuser 130 may pass through the reduction part 302 decreasing in the maximum flow rate without a decrease in the air volume, that is, while maintaining the average flow rate, and then be discharged to the filter 109 through the body outlet 103. Part of the air discharged from the diffuser 130 may be directly discharged to the filter 109 through the hole 302*a* of the reduction part 302 without passing through the body outlet 103.

Referring to FIG. 7, air in which rubbish has been filtered out by the dust collection device 60 may flow into the fan motor 110. The air introduced into the fan motor 110 may pass through the motor 111 and across the circuit board 112 and have heat exchanged heat with the motor 111 and the circuit board 112. Accordingly, heat of the motor 111 and the circuit board 112 may be dissipated.

The air passed through the motor 111 and across the circuit board 112 may pass through the impeller 120. The air passed through the impeller 120 may be introduced into the diffuser 130. The air passing through the diffuser 130 may be diffused and discharged.

The air discharged from the diffuser 130 is caused to pass through the reduction part 302. In the reduction part 302, the air may be reduced in the maximum flow rate without a decrease in the air volume, that is, while the average flow rate is maintained. Although part of the air passing through the reduction part 302 may be directly discharged to the filter 109 through the hole 302*a* without passing through the body outlet 103, since there are holes 302*a* of which the number is less than or equal to a predetermined number and/or the area is smaller than or equal to a predetermined area, noise generated from the filter 109 may be reduced.

The air passed through the reduction part 302 may be discharged into the space between the body 101 and the filter housing 106 through the body outlet 103. The air discharged into the space between the body 101 and the filter housing 106 is caused to pass through the filter 109. While the air is passing through the filter 109, fine-sized dust may be filtered out. The air passed through the filter 109 may be discharged to the outside of the cleaner 2 through the cover outlet 107 of the filter housing 106.

Specific embodiments illustrated in the drawings have been described above. However, the disclosure is not limited to the embodiments described above, and those of ordinary skill in the art to which the disclosure pertains may make various changes thereto without departing from the gist of the technical concept of the disclosure defined in the claims below.

Although the present disclosure has been described with various embodiments, various changes and modifications may be suggested to one skilled in the art. It is intended that the present disclosure encompass such changes and modifications as fall within the scope of the appended claims.

What is claimed is:

1. A cleaner comprising:
a main body; and
a fan motor configured to generate a suction force inside the main body,
wherein the fan motor includes:
a motor configured to generate a rotational force;
an impeller rotatable by the motor; and
a diffuser configured to guide air discharged from the impeller,
a motor cover being tapered inwardly and outwardly, and
wherein the main body includes:
a body including:
a reduction part configured to reduce a maximum flow rate while maintaining an average flow rate of air discharged from the diffuser, and
a body outlet configured to guide the air passed through the reduction part; and
a filter with at least a portion disposed across the body outlet to filter out rubbish from the air discharged from the body outlet.

2. The cleaner of claim 1, wherein the reduction part is formed to block air from the diffuser from being discharged to the filter while passing through the reduction part.

3. The cleaner of claim 1, wherein the reduction part extends in a direction of a rotational axis of the impeller.

4. The cleaner of claim 1, wherein the reduction part has a cross-sectional area perpendicular to a rotational axis of the impeller that is larger than an area of an outlet of the diffuser.

5. The cleaner of claim 1, further comprising a reduction member disposed in the reduction part to reduce a flow rate of the air discharged from the diffuser.

6. The cleaner of claim 1, wherein the reduction part has a cylindrical shape with open ends.

7. The cleaner of claim 1, wherein the reduction part extends from the diffuser to the body outlet.

8. The cleaner of claim 1, wherein the filter is detachably mounted on the body.

9. The cleaner of claim 1, further comprising a filter housing detachably mounted on the body to cover the filter and having a cover outlet that is configured to discharge air passed through the filter to an outside of the main body.

10. The cleaner of claim 9, wherein the filter extends from the body outlet to the cover outlet.

11. The cleaner of claim 1, wherein the filter is provided as a high efficiency particulate air (HEPA) filter.

12. The cleaner of claim 1, wherein the motor is disposed on a side opposite to a side of the impeller on which the diffuser is disposed.

13. The cleaner of claim 1, wherein the diffuser is configured to discharge air in a direction parallel to a rotational axis of the impeller.

14. The cleaner of claim 1, wherein the filter extends along an outer circumferential surface of the main body on which the body outlet is formed.

15. The cleaner of claim 1, wherein the reduction part is configured to delay discharge of the air from the diffuser to the filter.

16. A cleaner comprising:
a main body; and
a fan motor configured to generate a suction force inside the main body, wherein the fan motor includes:
a motor configured to generate rotational force;
an impeller rotatable by the motor;
a diffuser configured to guide air discharged from the impeller, and
a motor cover being tapered inwardly and outwardly,
wherein the main body includes:
a body outlet configured to guide the air discharged through the diffuser;
a filter with at least a portion extending to surround the body outlet to filter out rubbish from the air discharged from the body outlet; and a reduction part extending between the diffuser and the body outlet to reduce a maximum flow rate of air discharged from the diffuser while maintaining an average flow rate of the air, the reduction part configured to block the air from the diffuser from discharging to the filter while passing through the reduction part.

17. The cleaner of claim 16, wherein the reduction part has a cross-sectional area perpendicular to a rotational axis of the impeller that is larger than an area of an outlet of the diffuser.

18. The cleaner of claim 16, further comprising a filter housing having a cover outlet configured to cover the filter and configured to discharge air passed through the filter to an outside of the body, wherein the filter extends from the body outlet to the cover outlet.

19. The cleaner of claim 16, wherein the reduction part includes an extension length in a direction of a rotational axis of the impeller that is greater than or equal to 0.45 times an outer diameter of the diffuser.

20. The cleaner of claim 16, wherein the motor is disposed on another side opposite to a side of the impeller on which the diffuser is disposed.

* * * * *